US007479168B2

(12) United States Patent
O'Rear et al.

(10) Patent No.: US 7,479,168 B2
(45) **Date of Patent: *Jan. 20, 2009**

(54) STABLE LOW-SULFUR DIESEL BLEND OF AN OLEFINIC BLEND COMPONENT, A LOW-SULFUR BLEND COMPONENT, AND A SULFUR-FREE ANTIOXIDANT

(75) Inventors: Dennis J. O'Rear, Petaluma, CA (US); John E. Sundberg, Point Reyes Station, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 590 days.

This patent is subject to a terminal disclaimer.

(21) Appl. No.: 10/355,280

(22) Filed: Jan. 31, 2003

(65) Prior Publication Data

US 2004/0152930 A1 Aug. 5, 2004

(51) Int. Cl.
*C10L 1/18* (2006.01)
*C10L 1/22* (2006.01)
*C10L 1/04* (2006.01)

(52) U.S. Cl. ..... 44/412; 44/432; 44/450; 208/15

(58) Field of Classification Search ..... 44/426, 44/430, 450, 412, 432; 208/15
See application file for complete search history.

(56) References Cited

U.S. PATENT DOCUMENTS

| | | | | |
|---|---|---|---|---|
| 3,149,933 | A | 9/1964 | Ley et al. | |
| 4,320,020 | A | 3/1982 | Lange | |
| 4,320,021 | A | 3/1982 | Lange | |
| 4,347,148 | A | 8/1982 | Davis | |
| 4,386,939 | A | 6/1983 | Lange | |
| 4,425,138 | A * | 1/1984 | Davis | 44/427 |
| 4,456,541 | A * | 6/1984 | Wright | 508/556 |
| 4,568,663 | A | 2/1986 | Mauldin | |
| 5,506,272 | A | 4/1996 | Benham et al. | |
| 5,689,031 | A | 11/1997 | Berlowitz et al. | |
| 5,766,274 | A | 6/1998 | Wittenbrink et al. | |
| 5,807,413 | A * | 9/1998 | Wittenbrink et al. | 44/451 |
| 6,162,956 | A | 12/2000 | Berlowitz et al. | |
| 6,180,842 | B1 | 1/2001 | Berlowitz et al. | |
| 6,274,029 | B1 | 8/2001 | Wittenbrink et al. | |
| 6,296,757 | B1 | 10/2001 | Wittenbrink et al. | |
| 6,369,286 | B1 * | 4/2002 | O'Rear | 585/644 |
| 6,605,206 | B1 | 8/2003 | Johnson et al. | |
| 6,755,961 | B1 * | 6/2004 | Berlowitz et al. | 208/15 |
| 6,776,897 | B2 * | 8/2004 | Bacha et al. | 208/14 |
| 6,890,423 | B2 * | 5/2005 | O'Rear | 208/62 |
| 2003/0199719 | A1 | 10/2003 | Johnson et al. | |
| 2004/0148850 | A1 | 8/2004 | O'Rear et al. | |

FOREIGN PATENT DOCUMENTS

| | | | |
|---|---|---|---|
| EP | 0609079 | | 8/1994 |
| GB | 2129011 A | * | 5/1984 |
| WO | WO 96/23855 | * | 8/1996 |
| WO | 98/05740 | | 2/1998 |
| WO | 02/102944 | | 12/2002 |

OTHER PUBLICATIONS

Vardi J. et al. "Peroxide Formation in Low Sulfur Automotive Diesel Fuels" SAE paper 920826 (1992).
Pedley, J.F., et al., "Storage stability of petroleum-derived diesel fuel", *Fuel* 68:27-31 (1989).
Shah, P.P., "Upgrading of Light Fischer-Tropsch Products, Final Report", U.S. Dept. of Energy, DE91011315, Nov. 30, 1990.
United Kingdom Search Report dated Jun. 29, 2004.
Netherlands Search Report dated Jan. 4, 2005.
Robertson, S.D. et al. "Effect of automotive gas oil composition on elastomer behaviour", SAE Fuels & Lubricants Meeting (Baltimore Oct. 17-20, 1994) SAE Special Publication N. SP-1056 85-104 (1994).
Shah, P.P., et al., "Fischer-Tropsch Wax Characterization and Upgrading", Final Report, DOE contract No. AC22-85PC80017, Jun. 6, 1988.

* cited by examiner

*Primary Examiner*—Vasu Jagannathan
*Assistant Examiner*—Vickey Ronesi
(74) *Attorney, Agent, or Firm*—Crowell Moring LLP

(57) ABSTRACT

The present invention relates to a stable blended diesel fuel comprising an olefinic diesel fuel blending stock. The olefinic diesel fuel blending stock of the invention comprises olefins in an amount of 2 to 80 weight percent, non-olefins in an amount of 20 to 98 weight percent wherein the non-olefins are substantially comprised of paraffins, oxygenates in an amount of at least 0.012 weight percent and sulfur in an amount of less than 1 ppm. To provide acceptable stability, the blended diesel fuel comprising the olefinic diesel fuel blending stock comprises a sulfur-free antioxidant. The blended diesel fuel comprising the olefinic diesel fuel blending stock and sulfur-free antioxidant added has a peroxide content of less than 5 ppm when stored at 60° C. for 4 weeks. The present invention also relates to processes for making the stable blended diesel fuel and olefinic diesel fuel blending stocks as defined above.

23 Claims, No Drawings

STABLE LOW-SULFUR DIESEL BLEND OF AN OLEFINIC BLEND COMPONENT, A LOW-SULFUR BLEND COMPONENT, AND A SULFUR-FREE ANTIOXIDANT

CROSS-RELATED APPLICATION

The present application is related to U.S. patent application Ser. No. 10/355,284 entitled "Stable Olefinic, Low Sulfur Diesel Fuels" which is filed herewith.

FIELD OF THE INVENTION

The present invention relates to a stable blended diesel fuel or diesel fuel blending stock with low sulfur content, high olefin content, and oxygenates. More particularly, the present invention relates to a stable blended diesel fuel wherein at least a portion of the diesel fuel is derived from a Fischer Tropsch process.

BACKGROUND OF THE INVENTION

Stable diesel fuels with low sulfur contents and high cetane numbers, because of their low emissions and good engine performance, are desired. Fuels of this type can be prepared from Fischer-Tropsch products. The preparation of distillate fuels from Fischer Tropsch processes is well known.

While they are highly paraffinic, Fischer-Tropsch products also contain olefins, alcohols, and traces of other compounds that can cause problems with stability. Typically, hydroprocessing is used to saturate olefins and remove oxygenates. However, hydroprocessing requires the use of expensive hydrogen gas and expensive high pressure facilities and recycle compressors. It would be preferable not to hydroprocess all of the Fischer Tropsch products, especially those that are already in the distillate boiling range.

One method to avoid hydroprocessing all of the Fischer Tropsch products is to simply send the lighter fractions around the hydroprocessing unit and blend them directly into the distillate product without further treatment. The heavier fractions are converted into additional distillate product by hydrocracking. The distillate product from the hydrocracker and the lighter fractions directly from the Fischer Tropsch process are blended. This type of operation, and the preparation of distillate fuel containing olefins, has been described several times in the literature.

By way of example, "Upgrading of Light Fischer-Tropsch Products, Final Report, by P. P. Shah, Nov. 20, 1990 describes work performed under Contract No. AC22-86PC90014. DE91011315 (DOE/PC/90014-TB). FIG. 4.1 on page 4.14 of the report shows a Fischer Tropsch product from an Arge reactor being separated into a $C_{12}$-$C_{18}$ fraction and a $C_{19+}$ fraction. The $C_{19+}$ fraction is hydrocracked to form additional $C_{12-18}$ products, and the raw $C_{12-18}$ fraction from the Fischer Tropsch unit is blended with the $C_{12-18}$ fraction from the hydrocracker to form diesel. Since the $C_{12-18}$ fraction from the Fischer Tropsch unit will of natural consequence contain oxygenates, alcohols specifically, the blended product will also contain these oxygenates. The text on page 4.3 discloses that the Fischer Tropsch $C_{12-18}$ product contains oxygenates.

U.S. Pat. No. 5,506,272 also describes a Fischer Tropsch diesel fuel containing oxygenates. Table 3 in Column 18 describes a Fischer Tropsch diesel fuel with a cetane index of 62 and containing 6 wt % alcohols and 6 wt % other oxygenates.

U.S. Pat. No. 6,296,757 discloses a blend of hydrocracked wax with unhydrotreated hot and cold condensates. FIG. 1 illustrates how the product of the invention is a blend of hydrocracked wax and unhydrotreated hot and cold condensates. The unhydrotreated hot and cold condensates contain olefins and oxygenates, and therefore, the product taught in this patent will also contain olefins and oxygenates. In particular Example 2, column 6, lines 26-39 teaches a product (Fuel B). An analysis of Fuel B is shown in Table 1 in column 8. Fuel B contains 0.78 mmol/g of olefins as measured by the Bromine No. and 195 ppm oxygen as oxygenates. This Bromine Number is equivalent to a wt % olefins between 0.7 and 0.98 depending on the assumed molecular weight of the olefins.

U.S. Pat. No. 5,689,031 also discloses a clean distillate useful as a diesel fuel or diesel blending stock produced from Fischer-Tropsch wax made by separating wax into heavier and lighter fractions, further separating the lighter fraction, and hydroisomerizing the heavier fraction and that portion of the light fraction below about 500° F. The isomerized product is blended with the untreated portion of the lighter fraction. FIG. 1 illustrates the process for producing the product as described therein. FIG. 1 illustrates that the product is a blend of hydrocracked wax, hydrotreated cold condensate, and unhydrotreated hot condensate. The unhydrotreated hot condensate contains olefins and oxygenates, and therefore, the product contains olefins and oxygenates. In particular, Example 2, column 6, lines 49-61 teaches a product (Fuel B). An analysis of Fuel B is shown in Table 1 in column 8. Fuel B contains 0.78 mmol/g of olefins as measured by the Bromine No. and 195 ppm oxygen as oxygenates. This Bromine Number is equivalent to a wt % olefins between 0.7 and 0.98 depending on the assumed molecular weight of the olefins.

Similarly, U.S. Pat. No. 5,766,274 discloses a clean distillate useful as a jet fuel or jet blending stock produced from Fischer-Tropsch wax by separating wax into heavier and lighter fractions; further separating the lighter fraction and hydroisomerizing the heavier fraction and that portion of the light fraction above about 475° F. The isomerized product is blended with the untreated portion of the lighter fraction to produce jet fuel.

U.S. Pat. No. 6,274,029 discloses diesel fuels or blending stocks produced from non-shifting Fischer-Tropsch processes by separating the Fischer-Tropsch product into a lighter and heavier fractions, e.g., at about 700° F., subjecting the 700° F.+ fraction to hydro-treating, and combining the 700° F.+ portion of the hydrotreated product with the lighter fraction that has not been hydrotreated.

However, none of these processes as described in the prior art addresses the critical issue of stability of the fuel that is produced. Temperature, time, extent of oxygen exposure, impurities, and fuel composition are all important aspects of fuel stability. Fuel stability is determined by thermal stability and storage stability of the fuel. Thermal stability relates to the stability of the fuel when exposed to temperatures above ambient for relatively short periods of time. Storage stability generally relates to the stability of the fuel when stored at near ambient conditions for longer periods of time. A stable fuel can become unstable due to the introduction of other components, including incompatible fuel components. Components, which can cause a fuel to become unstable, include highly aromatic and heteroatom-rich fuel components, metals, oxidation promoters, and incompatible additives.

ASTM specifications for Diesel Fuel (D985) describe stability measurements for the respective fuels. For diesel fuel, ASTM D6468, "Standard Test Method for High Temperature Stability of Distillate Fuels" is under consideration as a standard test method for a diesel fuel and this test can provide a good measure of the stability of the fuel. Neat Fisher Tropsch products typically have excellent stabilities in this test.

In addition to conventional measurements of stability (thermal and storage), studies by Vardi et al (J. Vardi and B. J. Kraus, "Peroxide Formation in Low Sulfur Automotive Diesel Fuels," February 1992, SAE Paper 920826) describe how fuels can develop significant levels of peroxide during storage, and how these peroxides can attack fuel system elastomers (O-rings, hoses, etc.). The formation of peroxides can be measured by Infrared spectroscopy, chemical methods, or by the attack on elastomer samples. As described by Vardi et al, fuels can become unstable with respect to peroxide formation when their sulfur content is reduced to low levels by hydroprocessing. Vardi et al also describe how compounds like tetralin can cause fuels to become unstable with respect to peroxide formation, while polycyclic aromatic compounds like naphthalenes can improve stability. Vardi et al. explains that aromatics act as natural antioxidants and notes that natural peroxide inhibitors such as sulfur compounds and polycyclic aromatics can be removed.

Following on the work by Vardi, two recent patents from Exxon describe how the peroxide-stability of highly-paraffinic Fischer Tropsch products in unacceptable, but can be improved by the addition of sulfur compounds from other blend components. However, since sulfur compounds increase sulfur emissions, this approach is not desirable.

By way of example, U.S. Pat. No. 6,162,956 discloses a Fischer-Tropsch derived distillate fraction blended with either a raw gas field condensate distillate fraction or a mildly hydrotreated condensate fraction to obtain a stable, inhibited distillate fuel. The fuel is described as a blend material useful as a distillate fuel or as a blending component for a distillate fuel comprising: (a) a Fischer-Tropsch derived distillate comprising a $C_8$ −700° F. fraction, and (b) a gas field condensate distillate comprising a $C_8$ −700° F. fraction, wherein the sulfur content of the blend material is ≧1 ppm by wt. This patent discloses that distillate fuels derived from Fischer-Tropsch processes are hydrotreated to eliminate unsaturated materials, e.g., olefins, and most, if not all, oxygenates. This patent further discloses that the products contain less than or equal to 0.5 wt % unsaturates (olefins and aromatics).

Similarly, U.S. Pat. No. 6,180,842 discloses a Fischer-Tropsch derived distillate fraction blended with either a raw virgin condensate fraction or a mildly hydrotreated virgin condensate to obtain a stable inhibited distillate fuel. The fuel is describes as a blend material useful as a distillate fuel or as a blending component for a distillate fuel comprising (a) a Fischer-Tropsch derived distillate comprising a $C_8$ −700° F. stream and having a sulfur content of less than 1 ppm by wt, and (b) 1-40 wt % of a virgin distillate comprising a $C_8$ −700° F. stream; wherein the sulfur content of the blend material is ≧2 ppm by wt. This patent notes that while there is no standard for the peroxide content of fuels, there is general acceptance that stable fuels have a peroxide number of less than about 5 ppm, preferably less than about 4 ppm, and desirably less than about 1 ppm. This value is tested after storage at 60° C. in an oven for 4 weeks. The patent shows that Fischer Tropsch products having a peroxide number of 24.06 after 4 weeks have unacceptable stability.

The Fischer Tropsch products in the '842 patent are described as being >80 wt %, preferably >90 wt %, more preferably >95 wt % paraffins, having an iso/normal ratio of 0.1 to 10, preferably 0.3 to 3.0, more preferably 0.7 to 2.0; sulfur and nitrogen of less than 1 ppm each, preferably less than 0.5, more preferably less than 0.1 ppm each; ≦0.5 wt % unsaturates (olefins and aromatics), preferably ≦0.1 wt %; and less than 0.5 wt % oxygen on a water free basis, preferably less than about 0.3 wt % oxygen, more preferably less than 0.1 wt % oxygen and most preferably nil oxygen. The '842 patent teaches that the Fischer Tropsch distillate is essentially free of acids.

U.S. Pat. No. 5,689,031 demonstrates that olefins in low-sulfur diesel fuel contribute to peroxide formation. See Fuels C and D in Example 7, and FIG. 2. The '031 patent teaches that the solution to the peroxide forming tendency is to limit the olefin content by hydrotreating the lightest olefin fraction. However, this solution requires the use of expensive hydrogen gas.

It is desired to produce a diesel fuel that has low sulfur content economically, preferably without or with minimal expensive hydroprocessing, and obtain a diesel fuel that has acceptable stability, measured in terms of thermal stability, storage stability, and peroxide resistance. Therefore, it is desired that the diesel fuel be able to have a high olefin content and oxygenates, for example greater than or equal to 2 weight % olefins and greater than 0.012 weight % oxygenates, and exhibit acceptable stability. It is also desirable to produce a fuel of this type with satisfactory lubrication properties.

SUMMARY OF THE INVENTION

In one aspect the present invention relates to a blended diesel fuel. The blended diesel fuel comprises a) a diesel fuel fraction comprising olefins in an amount of 2 to 80 weight %, non-olefins in an amount of 20 to 98 weight %, wherein the non-olefins comprise greater than 50 weight % paraffins; and oxygenates in an amount of at least 0.012 weight %; b) a diesel fuel fraction selected from the group consisting of a hydrotreated Fischer Tropsch derived diesel, a hydrocracked Fischer Tropsch derived diesel, a hydrotreated petroleum derived diesel, and a hydrocracked petroleum derived diesel, and mixtures thereof; and c) an effective amount of at least one sulfur-free antioxidant. At least a portion of the blended diesel fuel is derived from Fischer Tropsch synthesis products and the blended diesel fuel comprises sulfur in an amount of less than 1 ppm. The blended diesel fuel according to the present invention has a reflectance as measured by ASTM D6468 of greater than 65% when measured at 150° C. for 90 minutes and a peroxide content of less than 5 ppm after storage at 60° C. for four weeks.

In another aspect the present invention relates to a blended diesel fuel comprising a) a Fischer Tropsch diesel fuel fraction comprising olefins in an amount of 2 to 80 weight %, non-olefins in an amount of 20 to 98 weight %, wherein the non-olefins comprise greater than 50 weight % paraffins, wherein the paraffins have an i/n ratio of less than 1, and oxygenates in an amount of at least 0.012 weight %; b) a diesel fuel fraction selected from the group consisting of a hydrocracked Fischer Tropsch derived diesel, a hydrotreated Fischer Tropsch derived diesel, a hydrocracked petroleum derived diesel, a hydrotreated petroleum derived diesel, and mixtures thereof; c) an effective amount of a sulfur-free antioxidant; and d) sulfur in an amount of less than 1 ppm. The diesel fuel according to the present invention has a reflectance as measured by ASTM D6468 of greater than 65% when measured at 150° C. for 90 minutes, and a peroxide content of less than 5 ppm after storage at 60° C. for four weeks.

In a yet another aspect, the present invention relates to a Fischer Tropsch diesel blend component. The diesel blend component comprises olefins in an amount of 2 to 80 weight %, non-olefins in an amount of 20 to 98 weight %, wherein the non-olefins comprise greater than 50 weight % paraffins, wherein the paraffins have an i/n ratio of less than 1; oxygenates in an amount of at least 0.012 weight %; a sulfur-free antioxidant; and sulfur in an amount of less than 1 ppm by weight.

In a further aspect, the present invention relates to a process for making a diesel fuel blend component. The process comprises converting at least a portion of a hydrocarbon asset to synthesis gas, and converting at least a portion of the synthesis gas to a hydrocarbon stream in a Fischer Tropsch process reactor. A diesel fraction is isolated from the hydrocarbon stream, wherein the diesel fraction comprises olefins in an amount of at 2 to 80 weight %; non-olefins in an amount of 20 to 98 weight %, wherein the non-olefins comprise paraffins in an amount of at least 50 weight %; oxygenates in an amount of at least 0.012 weight %; and sulfur in an amount of less 1 ppm. To the diesel fuel fraction is added at least one sulfur-free antioxidant.

In yet a further aspect, the present invention relates to a process for making a blended diesel fuel. The process comprises converting at least a portion of a hydrocarbon asset to synthesis gas and converting at least a portion of the synthesis gas to a hydrocarbon stream in a Fischer Tropsch reactor. A diesel fraction is isolated from the hydrocarbon stream, wherein the diesel fraction comprises olefins in an amount of at 2 to 80 weight %; non-olefins in an amount of 20 to 98 weight %, wherein the non-olefins comprise paraffins in an amount of at least 50 weight %; and oxygenates in an amount of at least 0.012 weight %. The Fischer Tropsch derived diesel fuel fraction is mixed with a diesel selected from the group consisting of a hydrocracked Fischer Tropsch derived diesel, a hydrotreated Fischer Tropsch diesel, a hydrocracked petroleum derived diesel, a hydrotreated petroleum diesel, and mixtures thereof to provide a blended diesel fuel. An effective amount of at least one sulfur-free antioxidant is added to the blended diesel. The blended diesel fuel comprises sulfur in an amount of less 1 ppm. The blended diesel fuel according to the present invention has a reflectance as measured by ASTM D6468 of greater than 65% when measured at 150° C. for 90 minutes and a peroxide content of less than 5 ppm after storage at 60° C. for four weeks.

In another aspect the present invention relates to a process for making a blended diesel fuel. The process comprises providing a Fischer Tropsch derived diesel fuel fraction comprising olefins in an amount of at 2 to 80 weight %; non-olefins in an amount of 20 to 98 weight %, wherein the non-olefins comprise paraffins in an amount of at least 50 weight %; and oxygenates in an amount of at least 0.012 weight %. The Fischer Tropsch derived diesel fuel fraction is mixed with a diesel selected from the group consisting of a hydrocracked Fischer Tropsch derived diesel, a hydrotreated Fischer Tropsch diesel, a hydrocracked petroleum derived diesel, a hydrotreated petroleum diesel, and mixtures thereof to provide a blended diesel fuel. An effective amount of at least one sulfur-free antioxidant is added to the blended diesel. The blended diesel fuel comprises sulfur in an amount of less 1 ppm. The blended diesel fuel according to the present invention has a reflectance as measured by ASTM D6468 of greater than 65% when measured at 150° C. for 90 minutes and a peroxide content of less than 5 ppm after storage at 60° C. for four weeks.

DETAILED DESCRIPTION OF THE INVENTION

The present invention relates to a low sulfur, stable, blended diesel fuel comprising olefins and oxygenates, wherein at least a portion of the blended diesel fuel is derived from a Fischer Tropsch process. It has been discovered that a stable, low sulfur blended diesel fuel can be prepared from a diesel fuel fraction comprising a high olefin content, (greater than 2 weight %, preferably greater than 5 weight %, more preferably greater than 10 weight %, even more preferably greater than 25 weight %, and even more preferably greater than 50 weight %), and oxygenates in an amount of at least 0.012 weight % by adding certain sulfur-free antioxidants to the blended diesel fuel. The blended diesel fuels according to the present invention will have an increase in peroxide number of less than about 5 ppm after storage at 60° C. in an oven for four weeks.

Fuels containing low sulfur contents, relatively high olefin contents, and oxygenates typically have problems with stability. In particular, these fuels rapidly form peroxides. Typically fuels containing high olefin content and oxygenates are subject to hydroprocessing. Hydroprocessing is the reaction of a hydrocarbonaceous feed with hydrogen over a catalyst at elevated temperature and pressure. The broad category of hydroprocessing can be divided into hydrotreating and hydrocracking. In hydrotreating, the goal is to remove heteroatoms, saturate olefins, saturate aromatics while minimizing the conversion to lower molecular weight species. Typically, Fischer-Tropsch products containing olefins and oxygenates are subjected to hydroprocessing to saturate the olefins and remove the oxygenates. However, hydroprocessing, requires the use of expensive hydrogen. At least one of the blending components in the blended diesel fuel of the present invention is not subjected to hydroprocessing. Accordingly, the blended diesel fuels of the present invention have relatively high olefin contents and oxygenates and can be produced more economically than diesel fuels that have been completely hydroprocessed. The blending component that is not hydroprocessed does not require the use of expensive hydrogen gas.

According to the present invention, it has been surprisingly discovered that certain sulfur-free antioxidants may be added to a blended diesel fuel comprising a diesel blending component containing high olefin content and oxygenates and provide a blended fuel that retains its low sulfur content and is stable. Accordingly, an effective amount of a sulfur-free antioxidant is added to the blended diesel fuel comprising the diesel blended component containing a high olefin content and oxygenates and a blended diesel fuel that has a reflectance as measured by ASTM D6468 of greater than 65% when measured at 150° C. for 90 minutes and a peroxide content of less than 5 ppm after storage at 60° C. for four weeks is provided. The sulfur-free antioxidant can be added to the blending component prior to blending or to the blended diesel fuel. The sulfur-free should be added to the blended diesel fuel or the diesel blending component containing olefins and oxygenates as rapidly as possible after formation of the diesel blending component to limit the formation of peroxides in the blended diesel. The preferred sulfur-free antioxidants are selected from the group of aromatic-amines, hindered phenols, and blends of aromatic amines and hindered phenols.

Definitions

The following terms will be used throughout the specification and will have the following meanings unless otherwise indicated.

The term "diesel fuel" means a hydrocarbon material with boiling points between $C_5$ and 800° F., preferably between 280 and 750° F. $C_5$ analysis is performed by gas chromatography, and the temperatures refer to the 95% boiling points as measured by ASTM D-2887. Preferably, the diesel fuel meets specifications for a diesel fuel as defined in ASTM-975-98.

The term "paraffin" means a saturated straight or branched chain hydrocarbon (i.e., an alkane).

The term "olefins" means an unsaturated straight or branched chain hydrocarbon having at least one double bond (i.e., an alkene).

The term "olefinic diesel fuel fraction" or "olefinic diesel fuel blend component" means a diesel fuel fraction containing oxygenates in an amount of at least 0.012 weight %, 2 to 80 wt % olefins, and 20 to 98 wt % non-olefins. The non-olefins are substantially comprised of paraffins. Preferably, the olefinic diesel fuel fraction contains greater than or equal to 5 wt % olefins, more preferably greater than 10 wt % olefins, more preferably greater than 25 wt % olefins, and even more preferably greater than 50 wt %. Preferably the non-olefins of the olefinic diesel fuel fraction comprise greater than 50 wt % paraffins, more preferably greater than 75 wt % paraffins, and even more preferably greater than 90 wt % paraffins (i.e., the percent paraffins is on the basis of the non-olefins). Preferably, the olefinic diesel fuel fraction also contains less than 10 ppm sulfur and less than 10 ppm nitrogen, and more preferably both sulfur and nitrogen are less than 5 ppm and even more preferably less than 1 ppm. Preferably the olefinic diesel fuel fraction contains less than 10 wt % aromatics, more preferably less than 5 wt % aromatics, and even more preferably less than 2 wt % aromatics. Olefins and aromatics are preferably measured by SCFC (Supercritical Fluid Chromatography).

The term "oxygenates" means a hydrocarbon containing oxygen, i.e., an oxygenated hydrocarbon. Oxygenates include alcohols, ethers, carboxylic acids, esters, ketones, and aldehydes, and the like.

The term "i/n ratio" means isoparaffin/normal paraffin weight ratio. It is the ratio of the total number of iso-paraffins (i.e., branched) to the total number of normal-paraffins (i.e., straight chain) in a given sample.

The term "alkyl" means a linear saturated monovalent hydrocarbon radical of one to eight carbon atoms or a branched saturated monovalent hydrocarbon radical of three to eight carbon atoms. Examples of alkyl groups include, but are not limited to, groups such as methyl, ethyl, n-propyl, isopropyl, n-butyl, isobutyl, sec-butyl, t-butyl, n-pentyl, and the like.

The term "nitro" means the group —$NO_2$.

The term "hydroxy" means the group —OH.

The term "cycloalkyl" means a cyclic saturated hydrocarbon group of 3 to 8 ring atoms, where one or two of C atoms are optionally replaced by a carbonyl group. The cycloalkyl group may be optionally substituted with one, two, or three substituents, preferably alkyl, alkenyl, halo, hydroxyl, cyano, nitro, alkoxy, haloalkyl, alkenyl, and alkenoxy. Representative examples include, but are not limited to, cyclopropyl, cyclohexyl, cyclopentyl, and the like.

The term "aromatic" means unsaturated cyclic hydrocarbons containing one or more aromatic rings.

The term "aryl" means a monovalent monocyclic or bicyclic aromatic carbocyclic group of 6 to 14 ring atoms. Examples include, but are not limited to, phenyl, naphthyl, and anthryl. The aromatic ring may be optionally fused to a 5-, 6-, or 7-membered monocyclic non-aromatic ring optionally containing 1 or 2 heteroatoms independently selected from oxygen, nitrogen, or sulfur, the remaining ring atoms being C where one or two C atoms are optionally replaced by a carbonyl. Representative aryl groups with fused rings include, but are not limited to, 2,5-dihydro-benzo[b]oxepine, 2,3-dihydrobenzo[1,4]dioxane, chroman, isochroman, 2,3-dihydrobenzofuran, 1,3-dihydroisobenzofuran, benzo[1,3]dioxole, 1,2,3,4-tetrahydroisoquinoline, 1,2,3,4-tetrahydroquinoline, 2,3-dihydro-1Hindole, 2,3-dihydro1H-isoindle, benzimidazole-2-one, 2-H-benzoxazol-2-one, and the like.

The term "phenyl" means a six membered aromatic group (i.e., $C_6H_5$—).

The term "phenol" means a six membered aromatic compound in which one or more hydroxy groups are attached directly to the ring.

The term "alkylphenol" means a phenolic compound in which one or more of the remaining hydrogen atoms attached directly to the ring are replaced by alkyl groups. Preferably, the alkylphenol has one hydroxy group and one alkyl group directly attached to the ring and is a compound of the formula $C_6H_4(OH)(R)$ wherein R is an alkyl group.

The term "cyclic amine" means refers to an amino compound in which one of the groups attached to the —N— of the amine is a cycloalkyl or an aryl.

The term "derived from a Fischer-Tropsch process" or "Fischer Tropsch derived" means that the product, fraction, feed, or fuel in question originates from or is produced at some stage by a Fischer-Tropsch process.

The term "sulfur-free antioxidant" means an antioxidant that contains sulfur only at the impurity level. Accordingly, the sulfur-free antioxidants of the present invention contain essentially no sulfur. A sulfur-free antioxidant contains less than 100 ppm sulfur, preferably less than 10 ppm sulfur, and even more preferably no undetectable level of sulfur. A sulfur-free antioxidant has a sulfur content low enough that when the antioxidant is added to a fuel, the fuel plus antioxidant has a sulfur content of less than 1 ppm. For example, assuming the fuel itself contains no sulfur, and that 100 ppm of the antioxidant are added to the fuel, the sulfur-free antioxidant contains less than 1 weight % sulfur.

The term "petroleum-derived diesel components" or "petroleum-derived distillate" means the vapor overhead streams from distilling petroleum crude and the residual fuels that are the non-vaporizable remaining portion. A source of the petroleum-derived can be from a gas field condensate.

The term "effective amount of a sulfur-free antioxidant" means the amount added to a blended diesel fuel comprising an olefinic diesel component (i.e., containing olefins in an amount of at least 2 weight %, oxygenates in an amount of at least 0.012 weight %, and sulfur in an amount of less than 1 ppm) to provide a diesel fuel having a reflectance as measured by ASTM D6468 of greater than 65% when measured at 150° C. for 90 minutes and a peroxide content of less than 5 ppm after storage at 60° C. for four weeks.

The term "effective amount of a lubricity agent" means the amount added to a blended diesel fuel comprising an olefinic diesel component (i.e., containing olefins in an amount of at least 2 weight %, oxygenates in an amount of at least 0.012 weight %, and sulfur in an amount of less than 1 ppm) to provide a diesel fuel with an ASTM D6079 wear scar of 450 microns or less.

The term "hydrotreated Fischer-Tropsch derived distillate fuel" means a distillate fuel that is derived from hydrotreating a $C_5$ to 750° F. containing Fischer-Tropsch product.

The term "hydrocracked Fischer-Tropsch derived distillate fuel" means a distillate fuel that is derived from hydrocracking a 750° F.+ containing Fischer-Tropsch product.

The term "hydrocracked petroleum derived distillate fuel" means a distillate fuel that is derived from hydrocracking 750° F.+ containing petroleum derived products.

The term "hydrotreated petroleum derived distillate fuel" means a distillate fuel that is derived from hydrotreating a $C_5$ to 750° F. containing petroleum derived product.

It has been surprisingly discovered that a blended diesel fuel comprising low sulfur and relatively high oxygenates and olefins can be prepared that has acceptable stability according to both conventional tests of stability and peroxide resistance.

The blended diesel fuels of the present invention comprise an olefinic diesel fuel blend component. The blended diesel fuel of the present invention provides certain advantages over typical diesel fuels containing blending components derived from Fischer-Tropsch processes. For example, the costs associated with producing the olefinic diesel fuel blending component, and hence the blended diesel fuel, are reduced because a hydroprocessing step, and thus expensive hydrogen, is not required to manufacture the olefinic diesel fuel blending component. In addition, the olefinic diesel fuel blend component and the blended fuel of the present invention have low sulfur contents and thus low sulfur emissions. Moreover, the blended diesel fuels of the present invention have acceptable stabilities as measured according to conventional measurements of stability (thermal and storage stability) and peroxide formation.

Accordingly, the present invention relates to a blended diesel fuel with acceptable stability wherein the blended diesel comprises an olefinic diesel fuel blend component. The invention further relates to the process to produce the olefinic diesel fuel blend component and the blended diesel fuel. The olefinic diesel fuel blend component has a relatively high olefin content (2 to 80 wt %, preferably 10 to 80 wt %, more preferably 25 to 80 wt %, and even more preferably 50 to 80 wt %), a low sulfur content (less than 10 ppm by weight, preferably less than 5 ppm, and even more preferably less than 1 ppm), and an oxygenate content of at least 0.012 weight percent. The blended diesel fuel of the present invention comprising this olefinic blend component displays acceptable stability according to conventional tests of stability and acceptable peroxide resistance—forms less than 5 ppm peroxides after storage at 60° C. for four weeks.

At least a portion of the olefinic diesel fuel blend component of the present invention is made by a Fischer-Tropsch process, preferably the olefinic diesel fuel blend component is made by a Fischer-Tropsch process. A Fischer Tropsch derived diesel fuel blend component of the present invention may be made by a process in which at least a portion of a hydrocarbon asset is converted to synthesis gas and at least a portion of the synthesis gas is converted to a hydrocarbon stream in a Fischer Tropsch process reactor. The hydrocarbon asset can be selected from the group consisting of coal, natural gas, petroleum, and combinations thereof. In the process a diesel fraction is isolated from the hydrocarbon stream comprising olefins in an amount of at least 2 weight %, paraffins in an amount of at least 70 weight %, oxygenates in an amount of at least 0.012 weight %, and sulfur in an amount of less 1 ppm.

More specifically, in a Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149 to 371° C.) preferably about from 400° to 550° F. (204 to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from $C_1$ to $C_{200+}$ with a majority in the $C_5$-$C_{100+}$ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. Nos. 4,568,663.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_5$-$C_{20}$ range, with decreasing amounts up to about $C_{30}$. The waxy reaction product (i.e. the wax fraction) includes hydrocarbons boiling above about 600° F. (e.g., vacuum gas oil through heavy paraffins), largely in the $C_{20+}$ range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The olefinic diesel fuel blend component of the present invention may be isolated from the products of the Fischer Tropsch process by distillation. The olefinic diesel fuel blend component of the present invention has a boiling point between $C_5$ and 800° F. and preferably between 280° F. and 750° F. $C_5$ analysis is performed by gas chromatography, and the temperatures refer to the 95% boiling points as measured by ASTM D-2887.

The olefinic diesel fuel blend component of the present invention comprises olefins in an amount of 2 to 80 weight %, non-olefins in an amount of 20 to 98 weight %, wherein the nonolefins substantially comprise paraffins, and oxygenates in an amount of at least 0.012 weight %. Preferably the olefinic diesel fuel blend component comprises sulfur in an amount of less than 1 ppm. Preferably, olefinic diesel fuel blend component contains greater than or equal to 10 wt % olefins, more preferably greater than or equal to 25 wt % olefins, and even more preferably greater than or equal to 50 wt % olefins. The olefins of the blend component are predominantly linear primary olefins, thus providing a higher cetane number.

The non-olefins of the blend component are predominantly paraffinic. Preferably the non-olefins are greater than 50 wt % paraffins, more preferably greater than 75 wt % paraffins, and even more preferably greater than 90 wt % paraffins (based on the non-olefin component). The paraffins of the non-olefinic component are predominantly n-paraffins. Preferably the paraffins have an i/n ratio of less than 1.0 and more preferably less than 0.5.

In addition, preferably, the olefinic diesel fuel blend component contains less than 10 ppm sulfur, more preferably less than 5 ppm sulfur, and even more preferably less than 1 ppm sulfur. The olefinic diesel fuel blend component also preferably contains less than 10 ppm nitrogen, more preferably less than 5 ppm nitrogen and even more preferably less than 1 ppm nitrogen. Furthermore, the olefinic diesel fuel blend component preferably contains less than 10 wt % aromatics, more preferably less than 5 wt % aromatics, and even more preferably less than 2 wt % aromatics. Olefins and aromatics are preferably measured by SCFC (Supercritical fluid chromatograph).

To retain the olefin content and oxygenates content of the diesel fuel blend component, the diesel fuel blend component of the present invention is not subjected to hydroprocessing. Since the blend component is not completely hydroprocessed, the blend component and thus the blended diesel fuel of the present invention are produced more economically than hydroprocessed diesel fuels.

The olefinic diesel fuel blend component according to the present invention may be used for any purpose for which a diesel fuel blend component is appropriate. Preferably, the olefinic diesel fuel blend component is appropriately blended to provide a blended diesel fuel. A blended diesel fuel according to the present invention comprises the olefinic diesel fuel blend component, as described above, and a diesel fuel fraction selected from the group consisting of a hydrotreated Fischer-Tropsch derived diesel fuel, a hydrocracked Fischer-Tropsch derived diesel fuel, a hydrotreated petroleum derived diesel fuel, a hydrocracked petroleum derived diesel fuel, and mixtures thereof. At least a portion of the blended diesel fuel of the present invention is derived from a Fischer-Tropsch process.

The blended diesel fuel according to the present invention may comprise varying amounts of olefinic diesel fuel blend component versus the other diesel fuel fraction, as defined above. Preferably the blended diesel fuel comprises 0.5 to 80 weight % olefinic diesel fuel blend component and 99.5 to 20 weight % other diesel fuel fraction. More preferably, the blended distillate fuel comprises 2 to 50 weight % olefinic diesel fuel blend component and 50 to 98 weight % other diesel fuel fraction and even more preferably 5 to 50 weight % diesel fuel blend component and 50 to 95 weight % other diesel fuel fraction.

The blended diesel fuel according to the present invention is made by a process comprising mixing an olefinic diesel fuel fraction or blend component, as defined herein, with a diesel fuel fraction selected from the group consisting of a hydrocracked Fischer-Tropsch derived diesel fuel, a hydrotreated Fischer-Tropsch derived diesel fuel, a hydrocracked petroleum derived diesel fuel, a hydrotreated petroleum derived diesel fuel, and mixtures thereof to provide a blended diesel fuel. A source of the petroleum desired diesel can be from a gas field condensate. The olefinic diesel fuel fraction or blend component has a composition as described herein and is made by processes as described herein. The blended diesel fuel comprises sulfur in an amount of less than 10 ppm by weight, preferably less than 5 ppm by weight, and even more preferably less than 1 ppm by weight.

To provide a stable low sulfur blended diesel fuel containing olefins and oxygenates, as described herein, certain sulfur-free antioxidants are added. The addition of the sulfur-free antioxidant should be done as soon as possible after the formation of the olefinic diesel fuel blend component to limit the formation of peroxides. The sulfur-free antioxidant may be added to the olefinic diesel fuel blend component or to the blended diesel fuel comprising the olefinic diesel blend component. The proper concentration of the antioxidant necessary to achieve the desired stability varies depending upon the antioxidant used, the type of fuel employed, the type of engine, and the presence of other additives. The sulfur-free antioxidant is added in an amount to provide a fuel having a reflectance as measured by ASTM D6468 of greater than 65% when measured at 150° C. for 90 minutes and a peroxide content of less than 5 ppm after storage at 60° C. for four weeks. In general the sulfur-free antioxidant is added in an amount of 5 to 500 ppm by weight, more preferably 8 to 200 ppm, and even more preferably 20 to 100 ppm.

The sulfur-free antioxidants of the present invention contain sulfur only at the impurity level. The sulfur-free antioxidants provide a fuel plus antioxidant that contains less than 1 ppm sulfur. Assuming that the fuel itself contains no sulfur and that 100 ppm of the antioxidant is used, the antioxidant contains less than 1 wt % sulfur, preferably less than 100 ppm sulfur, and even more preferably less than 10 ppm sulfur.

The sulfur-free antioxidants that are effective in the present invention are preferably selected from the group consisting of phenols, cyclic amines, and combinations thereof. Preferably, the phenols contain one hydroxyl group, but para cresols (i.e., two hydroxyl groups) are also effective. Preferably the phenols are hindered phenols.

The cyclic amine antioxidants according to the present invention preferably are cyclic amines having the following formula:

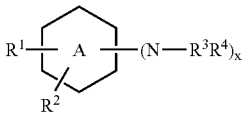

wherein:

A is a six-membered cycloalkyl or aryl ring, $R^1$, $R^2$, $R^3$, and $R^4$ are independently H or alkyl; and x is 1 or 2.

The phenol antioxidants according to the present invention preferably are alkylphenols having the formula:

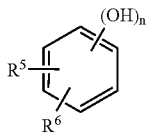

wherein $R^5$ and $R^6$ are independently H or alkyl and n is 1 or 2.

Examples of sulfur-free antioxidants according to the present invention include 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tertbutyl-4-methylphenol, 2,6-di-tertbutyl-4-ethylphenol, 2,4-dimethyl-6-tert-butyl-phenol, 2,6-di-tert-butyl dimethylamino-p-cresol, 2,6-di-tert-4-(N,N'-dimethyl-aminomethylphenol), bis(3,5-di-tert-butyl-4-hydroxybenzyl), alkylated diphenylamine, phenyl-alpha-naphthylamine, alkylated-alpha-naphthylamine, and combinations thereof.

Further examples of sulfur-free antioxidants of the present invention include methylcyclohexylamine, N,N'-di-sec-butyl-p-phenylenediamine, 2,6-di-tert-butylphenol, 4-tert-butylphenol, 2-tert-butylphenol, 2,4,6-tri-tert-butylphenol, and combinations thereof.

A further example of a sulfur-free antioxidant that may be used in the present invention are amino phenols as taught in U.S. Pat. No. 4,320,021, issued Mar. 16, 1982 to R. M. Lange. The amino phenols disclosed therein have at least one substantially saturated hydrocarbon-based substituent of at least 30 carbon atoms. Similar amino phenols, which may also be used in the present invention, are disclosed in related U.S. Pat. No. 4,320,020, issued Mar. 16, 1982 to R. M. Lange. In addition, U.S. Pat. No. 3,149,933, issued Sep. 22, 1964 to K. Ley et al., discloses hydrocarbon-substituted amino phenols that may also be used in the present invention.

Further examples of amino phenols, which may be used in the present invention, are as disclosed in U.S. Pat. No. 4,386,939, issued Jun. 7, 1983 to R. M. Lange. The '939 patent discloses nitrogen-containing compositions prepared by reacting an amino phenol with at least one 3- or 4-membered ring heterocyclic compound in which the hetero atom is a single oxygen, sulfur or nitrogen atom, such as ethylene oxide. The nitrogen-containing compositions of this patent may be used in the present invention.

Nitro phenols may also be used in the present invention. Nitro phenols are disclosed, for example, in U.S. Pat. No. 4,347,148, issued Aug. 31, 1982 to K. E. Davis. The nitro phenols disclosed therein contain at least one aliphatic substituent having at least about 40 carbon atoms.

The antioxidants of the present invention may be used singly or in combination. Preferably, mixtures of antioxidants are used. Preferred sulfur-free antioxidants according to the present invention are selected from the group consisting of aryl-amines, hindered phenols, and blends thereof. Preferably, the sulfur-free antioxidant as used in the present invention is a blend of a phenol and a cyclic amine. Blends of aryl-amines and hindered phenols are especially preferred.

The blended diesel fuels of the present invention with the addition of a sulfur-free antioxidant exhibit acceptable stability in both convention tests of stability (thermal and storage) and resistance to peroxide formation.

ASTM D975, "Standard Specification for Diesel Fuel Oils," describes stability measurements for diesel fuel. ASTM D6468, "Standard Test Method for High Temperature Stability of Distillate Fuels," is under consideration as a standard test method for diesel fuel and can provide a good measure of the stability of the fuel.

A blended diesel fuel according to the present invention containing an effective amount of a sulfur-free antioxidant will have an ASTM D6468 reflectance value when measured at 150° C. after 90 minutes of 65% or greater, preferably 80% or greater, and even more preferably 90% or greater. For extremely stable materials, the test can be run at 180 minutes and materials should shown a reflectance of 65% or greater, preferably 80% or greater, and most preferably 90% or greater.

A blended diesel fuel according to the present invention containing an effective amount of a sulfur-free antioxidant will also have an increase in peroxide number of less than about 5 ppm, preferably less than about 4 ppm, and even more preferably less than about 1 ppm after storage at 60° C. in an oven for 4 weeks. The blended distillate may further include other additives that are commonly used for diesel fuels. A description of additives that may be used in the present invention is as described in the Chevron Corporation, *Technical Review Diesel Fuels*, pp. 55-64 (2000), herein incorporated by reference in its entirety. In particular, these additives may include, but are not limited to, antioxidants (especially low sulfur antioxidants), lubricity additives, pour point depressants, and the like.

The blended diesel fuels of the present invention can also exhibit satisfactory lubrication properties if a lubricity additive is added. Diesel fuel guidelines for fuel lubricity are described in ASTM D975. Work in the area of diesel fuel lubricity is ongoing by several organizations such as the International Organization for Standardization (ISO) and the ASTM Diesel Fuel Lubricity Task Force. These groups include representatives from the fuel injection equipment manufacturers, fuel producers, and additive suppliers. The charge of the ASTM task force has been the recommendation of test methods and a fuel specification for ASTM D975. ASTM D6078, a scuffing load ball-on-cylinder lubricity evaluator method, SLBOCLE, and ASTM D6079, a high frequency reciprocating rig method, HFRR, were proposed and approved as test methods. The following guidelines are generally accepted and may be used in the absence of a single test method and a single fuel lubricity value: fuels having a SLBOCLE lubricity value below 2,000 grams might not prevent excessive wear in injection equipment while fuels with values above 3,100 grams should provide sufficient lubricity in all cases. If HFRR at 60° C. is used, fuels with values above 600 microns might not prevent excessive wear while fuels with values below 450 microns should provide sufficient lubricity in all cases.

The blended diesel fuel of the present invention may further be blended with a non-alcohol lubricity additive to form a product with an HFRR wear scar of 450 microns or less as measured by ASTM D6079. Preferred lubricity additives are selected from the group consisting of acids and esters, with esters especially preferred, as acids can cause compatibility problems with other additives used in the lubricating oil, while esters do not.

The blended diesel fuel according to the present invention may meet the specifications for a diesel fuel and be used as such. Preferably, the blended diesel fuel meets specifications for a diesel fuel as defined in ASTM-975-98.

The blended diesel fuel according to the present invention is a superior diesel fuel in that it is stable and produced economically.

EXAMPLES

The invention will be further explained by the following illustrative examples that are intended to be non-limiting.

Example 1

Comparative Example—Preparation of a Fully Hydrogenated Diesel Fuel

A highly paraffinic diesel fuel was prepared from three individual Fischer-Tropsch components.

TABLE I

Properties of Fischer-Tropsch Feed Components

| Property | Component 1 | Component 2 | Component 3 |
|---|---|---|---|
| Wt % in blend | 27.8 | 23.1 | 49.1 |
| Gravity, °API | 56.8 | 44.9 | 40.0 |
| Sulfur, ppm | <1 | <1 | |
| Oxygen, ppm by Neut. Act. | 1.58 | 0.65 | |
| Chemical Types, Wt % by GC-MS | | | |
| Paraffins | 38.4 | 62.6 | 85.3 |
| Olefins | 49.5 | 28.2 | 1.6 |
| Alcohols | 11.5 | 7.3 | 9.3 |
| Other Species | 0.5 | 3.9 | 3.8 |
| Distillation by D-2887, ° F. by wt % | | | |
| 0.5/5 | 80/199 | 73/449 | 521/626 |
| 10/30 | 209/298 | 483/551 | 666/758 |
| 50 | 364 | 625 | 840 |
| 70/90 | 417/485 | 691/791 | 926/1039 |
| 95/99.5 | 518/709 | 872/1074 | 1095/1184 |

The blend was prepared continuously by feeding the different components down-flow to a hydroprocessing reactor. The reactor was filled with a catalyst containing alumina, silica, nickel, and tungsten. It was sulfided prior to use. The liquid hourly space velocity (LHSV) was varied between 0.7 and 1.4 $hr^{-1}$ to explore this effect, the pressure was held constant at 1000 psig, and the recycle gas rate was 4000 standard cubic feet per barrel (SCFB). The per-pass conversion was maintained at approximately 80% below the recycle cut point of 665-710° F. by adjusting the catalyst temperature.

The product from the hydroprocessing reactor after separation and recycling of unreacted hydrogen was continuously distilled to provide a gaseous by-product, a light naphtha, a diesel fuel, and an unconverted fraction. The unconverted fraction was recycled to the hydroprocessing reactor. The temperatures of the distillation column were adjusted to maintain the flash and cloud points at their target values of 58° C. and −18° C., respectively.

Diesel fuel was blended from several hours of consistent operation at 1.4 LHSV to provide the representative product A in the Table II.

TABLE II

Properties of Blended Distillate Fuel Products

| Sample ID | A | B |
|---|---|---|
| Gravity, °API | 52.7 | 52.5 |
| Nitrogen, ppm | 0.24 | 0.25 |
| Sulfur, ppm | <1 | 0.61 |
| Water, ppm by Karl Fisher, ppm | 21.5 | |
| Pour Point, ° C. | −23 | −23 |
| Cloud Point, ° C. | −18 | −18 |
| Flash Point, ° C. | 58 | 59 |
| Autoignition Temperature, ° F. | 475 | 410 |
| Viscosity at 25° C., cSt | 2.564 | 2.304 |

TABLE II-continued

Properties of Blended Distillate Fuel Products

| | | |
|---|---|---|
| Viscosity at 40° C., cSt | 1.981 | 1.784 |
| Cetane Number | 74 | 72.3 |
| Aromatics by Supercritical Fluid Chromatography, wt % | <1 | 0.9 |
| Neutralization No. | 0 | |
| Ash Oxide, Wt % | <0.001 | |
| Ramsbottom Carbon Residue, wt % | 0.02 | |
| Cu Strip Corrosion | 1A | |
| Color, ASTM D1500 | 0 | 0.2 |
| GC-MS Analysis | | |
| Paraffins, Wt % | 100 | 81.64 |
| Paraffin i/n ratio | 2.1 | 1.02 |
| Oxygen as oxygenates, ppm | <6 | 1226 |
| Olefins, Wt % | 0 | 17.52 |
| Average Carbon Number | 14.4 | 13.20 |

| Distillation by D-2887 by Wt %, ° F. and D-86 by Vol %, ° F. | D-2887 | D-86 | D-2887 | D-86 |
|---|---|---|---|---|
| 0.5/5 | 255/300 | 329/356 | 256/298 | 334/360 |
| 10/20 | 326/368 | 366/393 | 329/367 | 366/— |
| 30/40 | 406/449 | 419/449 | 400/429 | 413/— |
| 50 | 487 | 480 | 463 | 466 |
| 60/70 | 523/562 | 510/539 | 500/537 | —/519 |
| 80/90 | 600/637 | 567/597 | 574/605 | —/572 |
| 95/99.5 | 659/705 | 615/630 | 626/663 | 587/604 |

Oxygen can be present in the sample in the form of organic oxygenates, measured by gas chromatography-mass spectrometry (GC-MS), dissolved or suspended water, measured by Karl Fischer, or dissolved $O_2$ from the air.

The oxygenate content was determined by GC-MS. Oxygenates in the sample were treated with tetraethoxysilane (TEOS) to increase the sensitivity of the technique. Oxygenates could not be detected sample A. The limit of detection of the technique was determined to be 6.5 ppm per oxygenate. With the molecular weight range of diesel fuel this is equivalent to 0.6 ppm oxygen as oxygenates. Given that there are roughly 10 oxygenate compounds in a typical sample just below this limit of detection, the maximum amount of oxygen as oxygenates in the sample is 6 ppm (0.0006 weight %).

Using data from $O_2$ solubility in pure compounds it has been estimated that the solubility of $O_2$ in air sample A is approximately 92 ppm (0.0092 weight %). There are no readily available methods for measuring dissolved $O_2$. For purposes of lubricity, it is most meaningful to measure the oxygen as oxygenates on a water and dissolved $O_2$ free basis. The GC-MS analyses are shown in Table III.

TABLE III

GC-MS analysis of distillate fuel

| Formula | N-alkane area % | Branched alkane area % | Total alkanes | i/n by Carbon No. |
|---|---|---|---|---|
| $C_9H_{20}$ | 2.96 | 0.00 | 2.96 | — |
| $C_{10}H_{22}$ | 3.59 | 4.24 | 7.83 | 1.18 |
| $C_{11}H_{24}$ | 3.80 | 4.65 | 8.45 | 1.22 |
| $C_{12}H_{26}$ | 3.65 | 4.77 | 8.42 | 1.31 |
| $C_{13}H_{28}$ | 3.41 | 5.34 | 8.75 | 1.57 |
| $C_{14}H_{30}$ | 3.00 | 5.34 | 8.34 | 1.78 |
| $C_{15}H_{32}$ | 2.61 | 5.56 | 8.17 | 2.13 |
| $C_{16}H_{34}$ | 2.33 | 8.65 | 10.98 | 3.71 |
| $C_{17}H_{36}$ | 1.99 | 5.74 | 7.72 | 2.89 |
| $C_{18}H_{38}$ | 1.51 | 6.11 | 7.62 | 4.04 |
| $C_{19}H_{40}$ | 1.60 | 5.98 | 7.58 | 3.73 |
| $C_{20}H_{42}$ | 1.18 | 5.35 | 6.53 | 4.52 |

TABLE III-continued

| GC-MS analysis of distillate fuel | | | | |
|---|---|---|---|---|
| $C_{21}H_{44}$ | 0.58 | 3.82 | 4.41 | 6.54 |
| $C_{22}H_{46}$ | 0.22 | 2.00 | 2.23 | 8.94 |

| | |
|---|---|
| Percent Paraffins | 100.00 |
| Percent Olefins | 0.00 |
| Average Carbon Number | 15.12 |
| Boiling point of Avg. Carbon No. ° F. | 521 |
| Total sample paraffin i/n ratio | 2.08 |

As noted above, oxygenates were not detected in this sample. Also, the sample contains less than 1 weight % aromatics. The lack of aromatics further increases the likelihood that the sample will rapidly oxidize.

Example 2

Preparation of a Olefinic Diesel Fuel According to Patent Example

In this example, Component 1 of the Fischer-Tropsch product in Table I were by-passed around the hydroprocessing unit and fed directly to the distillation column. The same catalysts and conditions used in Example I, including an LHSV of 1.4, were used, and the conditions of the distillation column were adjusted to maintain flash and cloud points in the product as used in Example I. The yield of diesel fuel was less, near 73% due to requirement to reduce the end point of the diesel fuel to maintain cloud point.

Diesel fuel was blended from several hours of consistent operation to provide the representative product B in the Table II. In contrast to the operation where all the Fischer-Tropsch Tropsch components were fed to the hydroprocessing unit, by-passing the light components resulted in lower yields of diesel fuel which were due to the lower diesel end point. The latter was probably a results of the higher concentration of heavy n-paraffins in sample B. The GC-MS analysis of sample B are shown in Table IV.

TABLE IV

GC-MS analysis of Sample B

| Carbon No. | 1-alkenes | n-alkanes | i-alkanes | alcohols | Sum | Paraffin i/n ratio |
|---|---|---|---|---|---|---|
| $C_6$ | 0.00 | 0.00 | 0.00 | 0.03 | 0.03 | |
| $C_7$ | 0.00 | 0.00 | 0.00 | 0.21 | 0.21 | |
| $C_8$ | 0.00 | 0.00 | 0.00 | 0.32 | 0.32 | |
| $C_9$ | 2.49 | 2.49 | 2.13 | 0.21 | 7.32 | 0.86 |
| $C_{10}$ | 3.55 | 3.20 | 4.62 | 0.12 | 11.49 | 1.44 |
| $C_{11}$ | 3.91 | 3.91 | 4.97 | 0.03 | 12.82 | 1.27 |
| $C_{12}$ | 3.55 | 4.26 | 4.62 | 0.09 | 12.52 | 1.08 |
| $C_{13}$ | 2.35 | 4.36 | 4.69 | 0.00 | 11.39 | 1.08 |
| $C_{14}$ | 1.68 | 4.69 | 4.02 | 0.00 | 10.39 | 0.86 |
| $C_{15}$ | 0.00 | 4.36 | 6.03 | 0.00 | 10.39 | 1.38 |
| $C_{16}$ | 0.00 | 4.36 | 4.02 | 0.00 | 8.38 | 0.92 |
| $C_{17}$ | 0.00 | 4.36 | 3.35 | 0.00 | 7.71 | 0.77 |
| $C_{18}$ | 0.00 | 3.02 | 1.68 | 0.00 | 4.69 | 0.56 |
| $C_{19}$ | 0.00 | 1.34 | 1.01 | 0.00 | 2.35 | 0.75 |
| Sums | 17.52 | 40.32 | 41.14 | 1.02 | 100.00 | |

| | |
|---|---|
| Percent Paraffins | 81.46 |
| Percent Olefins | 17.52 |
| Average Carbon Number | 13.20 |
| Oxygen as oxygenates, ppm | 1226 |
| Total sample paraffin i/n ratio | 1.02 |

These results also show that when a portion of the Fischer-Tropsch product by-passes the hydroprocessing reactor and is blended into the final product, significant quantities of olefins are included in the product. The olefins in the product are in fact ten times greater than the alcohols. The olefins and oxygenates create concerns over stability.

Example 3

Lubricity Measurements

Portions of Sample A were blended with different lubricity additives at ppm concentrations listed, and the lubricity was measured by HFRR according to D6079. The oleic acid was supplied by Henkel corporation and was identified as product Edenor TI 5. The ester was supplied by Octel and was identified as product OLI 9000, described as a "Fully synthetic ester based non-acid lubricity additives for use in low sulfur diesel fuels."

TABLE V

Lubricity Measurements

| Additive | Concentration, ppm | | | |
|---|---|---|---|---|
| 2 ethyl hexanol | 0 | 500 | 0 | 0 |
| oleic acid | 0 | 0 | 300 | 0 |
| ester | 0 | 0 | 0 | 200 |
| Scar, microns | 593 | 624 | 357 | 268 |

These results show that the alcohol had no significant effect on the lubricity. While the structure of the alcohols was not a linear primary alcohol, the structure of the alcohol should not have a significant effect. In comparison, the standard oleic acid and ester significantly reduced the wear scar and improved the lubricity to the desired values. The poor lubricity improvements demonstrated by alcohols in comparison to acids and esters is consistent will well-known theories of lubrication.

Sample B which contained olefins and light alcohols will also likely not meet the target 450 micron limit. Thus, it is preferred that the distillate fuel of this invention also include commercial lubricity additives which contain acid and/or ester functions. Sufficient lubricity additive should be added to obtain a wear scar of 450 microns or less as measured by ASTM D6079.

Example 4

Stability Measurements

Sample B was tested according to ASTM D6468 at 150° C. for 180 minutes and found to have a stability of 99.3%, which indicates that it is extremely stable towards deposit formation in this test.

The samples were then to be tested for peroxide formation under accelerated formation according to the methods described in U.S. Pat. Nos. 6,162,956 and 6,180,842. The material was to be tested according to a standard procedure for measuring the buildup of peroxides. First, a 4 oz. sample is placed in a brown bottle and aerated for 3 minutes. An aliquot of the sample is then tested according to ASTM D3703 for peroxides. The peroxide content of the samples is measured by use of procedures following ASTM D3703 with exception that the Freon solvent is replaced by isooctane. Tests confirm that this substitution of solvents had no significant affect on the results. The sample is then capped and placed into a 60° C. oven for 1 week. After this time the peroxide number is repeated, and the sample is returned to the oven. The procedure continues each week until 4 weeks have elapsed and the final peroxide number is obtained. An increase in the value of the peroxide number of less than 5 is considered a stable distillate fuel; preferably the peroxide number increases by less than 4, and most preferably the peroxide number increases by less than 1. Table VI contains peroxide formation tendencies.

TABLE VI

Peroxide Formation Tendencies

| | A | B |
|---|---|---|
| Initial Peroxide No. | 1.3 | 8.2 |
| Peroxide No. after 1 weeks at 60° C. | 1.0 | 35 |
| Peroxide No. after 2 weeks at 60° C. | 1.5 | 156 |
| Peroxide No. after 3 weeks at 60° C. | 1.88 | 204 |
| Peroxide No. after 4 weeks at 60° C. | <5 | >5 |

An additional test of fuel A was done at 70° C. The initial peroxide number and the peroxide number after 4 weeks are both less than 1 ppm. These results indicate that sample A has significantly better peroxide stability than sample B. This demonstrates the very rapid peroxide forming tendencies of low-sulfur high-olefin content diesel fuels.

Example 5

Effect of Trace Olefins on Peroxide Stability

A further study was done to determine the effects of adding small amounts of olefinic condensate to the stable fuel of A of Table IV. A 300-600° F. portion of the cold condensate, Component 1 of Table I, was obtained by distillation. The properties of the 300-600° F. portion of the cold condensate are as follows:

TABLE VII

Properties of the 300-600° F. Portion of the Cold Condensate

| Property | Value |
|---|---|
| API Gravity, ° | 65.3 |
| Nitrogen, ppm | 0.79 |
| Sulfur, ppm | 2.29 |
| Bromine No. | 48.2 |
| Simulated Distillation, D-2887 ° F. by Wt % | |
| 0.5/5% | 296/302 |
| 10/30% | 332/383 |
| 50% | 393 |
| 70/90% | 459/523 |
| 95/99.5% | 551/654 |

A GC-MS analysis of the 300-600° F. portion of the cold condensate produced these results in weight %:

TABLE VIII

GC-MS analysis of the 300-600° F. Portion of the Cold Condensate

| Carbon No. | n-Alkenes | Alkanes | Alcohols | Sum |
|---|---|---|---|---|
| $C_6$ | 0.00 | 0.00 | 0.00 | 0.00 |
| $C_7$ | 0.00 | 0.00 | 1.54 | 1.54 |
| $C_8$ | 0.00 | 0.00 | 0.32 | 0.32 |
| $C_9$ | 2.20 | 3.30 | 1.32 | 6.82 |

TABLE VIII-continued

GC-MS analysis of the 300-600° F. Portion of the Cold Condensate

| | | | | |
|---|---|---|---|---|
| $C_{10}$ | 12.37 | 5.35 | 1.03 | 18.75 |
| $C_{11}$ | 11.46 | 5.28 | 0.81 | 17.54 |
| $C_{12}$ | 10.37 | 5.94 | 0.54 | 16.85 |
| $C_{13}$ | 8.43 | 5.72 | 0.29 | 14.44 |
| $C_{14}$ | 5.85 | 4.69 | 0.19 | 10.74 |
| $C_{15}$ | 3.31 | 3.01 | 0.00 | 6.32 |
| $C_{16}$ | 1.60 | 1.76 | 0.00 | 3.36 |
| $C_{17}$ | 0.73 | 0.95 | 0.00 | 1.69 |
| $C_{18}$ | 0.34 | 0.55 | 0.00 | 0.89 |
| $C_{19}$ | 0.15 | 0.33 | 0.00 | 0.48 |
| $C_{20}$ | 0.06 | 0.21 | 0.00 | 0.26 |
| Sums | 56.87 | 37.10 | 6.03 | 100.00 |

| | |
|---|---|
| Percent Paraffins | 37.10 |
| Percent Olefins | 56.87 |
| Average Carbon Number | 12.03 |
| Standard Deviation | 2.10 |
| Percent $C_{12}$-$C_{24}$ Material | 55.02 |
| Oxygen as oxygenates, ppm | 6769 |
| Oxygen as primary $C_{12}$-$C_{24}$ alcohols, ppm | 832 |
| Oxygen as primary $C_7$-$C_{12}$ alcohols, ppm | 6398 |

Example 6

The 300-600° F. portion of the cold condensate was blended in varying amounts with the stable fuel A of Table IV and the blends were evaluated for peroxide formation with the following results:

TABLE IX

Peroxide Formation of Blends 1-5

| Sample | Volume Cold Condensate, | Volume Stable Fuel | Olefins in the Blend, | Peroxide Result vs Weeks of Storage at 60° C., ppm | | | | |
|---|---|---|---|---|---|---|---|---|
| No. | ml | ml | Wt % | 0 | 1 | 2 | 3 | 4 |
| 1 | 0 | 100 | 0 | <1 | <1 | <1 | <1 | <1 |
| 2 | 0.2 | 99.8 | 0.1 | <1 | <1 | <1 | 1.1 | 1.0 |
| 3 | 0.5 | 99.5 | 0.3 | <1 | <1 | 1.6 | 5.3 | 6.7 |
| 4 | 1 | 99.0 | 0.6 | 1.2 | 2.5 | 7.7 | 20.0 | 37.0 |
| 5 | 2 | 98.0 | 1.13 | 1.1 | 5.6 | 23.2 | 53.0 | 58.0 |

These results show that the fuel prepared by hydrotreating the entire portion without direct blending of cold condensate is stable with respect to formation of peroxide. Stability with respect to formation of peroxide corresponds to less than 5 ppm, preferably less than 4 ppm, and most preferably less than 1 ppm, after 4 weeks at 60° C. Blends can tolerate up to 0.2 weight % cold condensate (0.012 wt % oxygenates as alcohols determined by GC-MS and about 0.1 wt % olefins) and still be considered stable. Blends with more than 0.012 wt % oxygenates or 0.1 wt % olefins did not exhibit satisfactory stability. As the oxygenate content was increased beyond 0.012 wt %, the peroxide stability of the fuel rapidly declined. As the olefin content was increased beyond 0.1 weight %, the peroxide stability of the fuel rapidly declined. This great sensitivity of peroxide stability, and the ability to form stable fuels is not predicted by the prior art.

Example 7

Impact of Antioxidants on Formation of Peroxides

The stability of olefinic, low-sulfur diesel fuels can be improved to meet the limits described above by incorporation of antioxidants typically used for distillate fuels and gasoline. This example explored the impact of antioxidants on the peroxide stability of blends of 20 volume % 300-600° F. cold condensate with 80% stable fuel, resulting in approximately 11% olefins and less than 1 ppm sulfur. The blends and evaluated for peroxide formation initially and after storage for various times at 60° C.

These additives used are more completely described by their manufacturers as follows: UOP No. 5 is described as an amine antioxidant, Baker/Petrolite Tolad 3910 as a blend of an amine and hindered phenol antioxidants, Octel FOA-3 as an antioxidant composed of a mixed polymeric amine, and Octel AO-37 as an antioxidant composed of hinder phenols.

TABLE X

Peroxide Formation of Blends 6-10

| Sample No. | Additive | Amount, ppm | 0 Weeks | 1 Weeks | 2 Weeks | 3 Weeks | 4 Weeks |
|---|---|---|---|---|---|---|---|
| 6 | None | 0 | 3.6 | 49.8 | 25.7 | 48.0 | 43.0 |
| 7 | UOP No. 5 | 8 | 3.4 | 36.1 | 39.2 | 49.0 | 78 |
| 8 | UOP No. 5 | 60 | 3.7 | 4.2 | 2.8 | 3.3 | 1.9 |
| 9 | Tolad 3910 | 8 | 3.3 | 36.7 | 31.5 | 58.0 | 101 |
| 10 | Tolad 3910 | 60 | 3.3 | 3.8 | 2.7 | 2.6 | 3.1 |
| 11 | Octel FOA-3 | 8 | 3.1 | 44.3 | 26.9 | 36.0 | 47 |
| 12 | Octel FOA-3 | 60 | 2.7 | 27.9 | 19.6 | 37.0 | 39 |
| 13 | Octel AO-37 | 8 | 3.3 | 50.0 | 34.6 | 48.0 | 88 |
| 14 | Octel AO-37 | 60 | 2.6 | 4.7 | 3.2 | 4.8 | 4.7 |

These results show that the non-additized sample quickly formed peroxides. Additives could work on the 11 weight % olefin sample, provided they were used in amounts greater than 8 ppm. However, OCTEL FOA-3 was ineffective. Additives that were effective in preventing a formation of peroxides contained hindered phenols, either as such or in combination with an amine with low molecular weight, a phenol, or both. The sulfur content of all these antioxidants was below 5 ppm.

As shown in the experimental section below, olefin-rich and low-sulfur diesel fuels have excellent stabilities in ASTM D6468 when they are tested neat, meaning free of additional components that might lead to instability.

Various modifications and alterations of this invention will become apparent to those skilled in the art without departing from the scope and spirit of this invention. Other objects and advantages will become apparent to those skilled in the art from a review of the preceding description.

The invention claimed is:

1. A blended diesel fuel comprising:

a) a diesel fuel fraction comprising olefins in an amount of 25 to 80 weight %; non-olefins in an amount of 20 to 75 weight %, wherein the non-olefins comprise greater than 50 weight % paraffins; and oxygenates in an amount of at least 0.012 weight %;

b) a diesel fuel fraction selected from the group consisting of a hydrotreated Fischer Tropsch derived diesel, a hydrocracked Fischer Tropsch derived diesel, a hydrotreated petroleum derived diesel, and a hydrocracked petroleum derived diesel, and mixtures thereof; and c) an effective amount of at least one sulfur-free antioxidant from the group consisting of phenols, cyclic amines, and combinations thereof;

wherein at least a portion of the blended diesel fuel is derived from Fischer Tropsch synthesis products and the blended diesel fuel comprises sulfur in an amount of less than 1 ppm, and has a reflectance as measured by ASTM D6468 of greater than 65% when measured at 150° C. for 90 minutes and a peroxide number of less than 5 ppm after storage at 60° C. for four weeks.

2. The blended diesel fuel according to claim 1, comprising 5 to 500 ppm of the at least one sulfur-free antioxidant.

3. The blended diesel fuel according to claim 1, comprising 8 to 200 ppm of the at least one sulfur-free antioxidant.

4. The blended diesel fuel according to claim 1, comprising 20 to 100 ppm of the at least one sulfur-free antioxidant.

5. The blended diesel fuel according to claim 1, wherein the at least one sulfur-free antioxidant is a cyclic amine having the following formula:

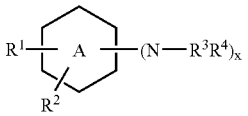

wherein:

A is a six-membered cycloalkyl or aryl ring, $R^1$, $R^2$, $R^3$, and $R^4$ are independently H or alkyl; and x is 1 or 2.

6. The blended diesel fuel according to claim 1, wherein the at least one sulfur-free antioxidant is an alkylphenol having the formula:

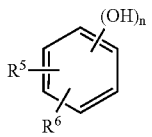

wherein $R^5$ and $R^6$ are independently H or alkyl and n is 1 or 2.

7. The blended diesel fuel according to claim 1, wherein the at least one sulfur-free antioxidant is selected from the group consisting of 4,4'-methylene-bis(2,6-di-tert-butylphenol), 4,4'-bis(2-methyl-6-tert-butylphenol), 2,2'-methylene-bis(4-methyl-6-tert-butyl-phenol), -4,4'-butylidene-bis(3-methyl-6-tert-butylphenol), 4,4'-isopropylidene-bis(2,6-di-tert-butylphenol), 2,2'-methylene-bis(4-methyl-6-nonylphenol, 2,2'-isobutylidene-bis(4,6-dimethylphenol), 2,2'-methylene-bis(4-methyl-6-cyclohexylphenol), 2,6-di-tertbutyl-4-methylphenol, 2,6-di-tertbutyl-4-ethylphenol, 2,4-dimethyl-6-tert-butyl-phenol, 2,6-di-tert-butyl-dimethylamino-p-cresol, 2,6-di-tert-4-(N,N'-dimethyl-aminomethylphenol), bis(3,5-di-tert-butyl-4-hydroxybenzyl), alkylated diphenylamine, phenyl-alpha-naphthylamine, alkylated-alpha-naphthylamine, and mixtures thereof.

8. The blended diesel fuel according to claim 1, wherein the at least one sulfur-free antioxidant is selected from the group consisting of dimethylcyclohexylamine, N,N'-di-sec-butyl-p-phenylenediamine, 2,6-di-tert-butylphenol, 4-tert-butylphenol, 2-tert-butylphenol, 2,4,6-tri-tert-butylphenol, and mixtures thereof.

9. The blended diesel fuel according to claim 1, wherein the at least one sulfur-free antioxidant is a blend of a phenol and a cyclic amine.

10. The blended diesel fuel according to claim 1, wherein the peroxide number is less than 4 ppm after storage at 60° C. for four weeks.

11. The blended diesel fuel according to claim 1, wherein the peroxide number is less than 1 ppm after storage at 60° C. for four weeks.

12. The blended diesel fuel according to claim 1, wherein the reflectance as measured by ASTM D6468 is greater than 80% when measured at 150° C. for 90 minutes.

13. The blended diesel fuel according to claim 1, wherein the reflectance as measured by ASTM D6468 is greater than 90% when measured at 150° C. for 90 minutes.

14. The blended diesel fuel according to claim 1, wherein at least a portion of the diesel fuel is derived from a petroleum derived distillate.

15. The blended diesel fuel according to claim 1, further comprising a lubricity additive in an amount to provide an ASTM D6079 wear scar of 450 microns or less.

16. The blended diesel fuel according to claim 15, wherein the lubricity additive is an ester.

17. The blended diesel fuel according to claim 16, wherein the diesel fuel has a reflectance as measured by ASTM D6468 of greater than 65% when measured at 150° C. for 180 minutes, an ASTM D6079 wear scar of 450 microns or less, and a peroxide content of less than 5 ppm after storage at 60° C. for four weeks.

18. A blended diesel fuel comprising:

a) a Fischer Tropsch diesel fuel fraction comprising
   i) olefins in an amount of 25 to 80 weight %,
   ii) non-olefins in an amount of 20 to 75 weight %, wherein the non-olefins comprise greater than 50 weight % paraffins, wherein the paraffins have an i/n ratio of less than 1; and
   iii) oxygenates in an amount of at least 0.012 weight %;

b) a diesel fuel fraction selected from the group consisting of a hydrocracked Fischer Tropsch derived diesel, a hydrotreated Fischer Tropsch derived diesel, a hydrocracked petroleum derived diesel, a hydrotreated petroleum derived diesel, and mixtures thereof;

c) an effective amount of a sulfur-free antioxidant; and d) sulfur in an amount of less than 1 ppm, wherein the blended diesel fuel has a reflectance as measured by ASTM D6468 of greater than 65% when measured at 150° C. for 90 minutes and a peroxide number of less than 5 ppm after storage at 60° C. for four weeks.

19. The blended diesel fuel according to claim 18, comprising 5 to 500 ppm of the at least one sulfur-free antioxidant.

20. The blended diesel fuel according to claim 18, comprising 20 to 100 ppm of the at least one sulfur-free antioxidant.

21. The blended diesel fuel according to claim 18, wherein the at least one sulfur-free antioxidant is selected from the group consisting of phenols, cyclic amines, and combinations thereof.

22. The blended diesel fuel according to claim 18, wherein the blended diesel fuel comprises 5 to 80 weight % Fischer-Tropsch diesel fuel fraction of (a) and 20 to 95 weight % diesel fuel fraction of (b).

23. A Fischer Tropsch diesel blend component comprising:

a) olefins in an amount of 25 to 80 weight %, b) non-olefins in an amount of 20 to 75 weight %, wherein the non-olefins comprise greater than 50 weight % paraffins, wherein the paraffins have an i/n ratio of less than 1; and c) oxygenates in an amount of at least 0.012 weight %;

d) a sulfur-free antioxidant; and e) sulfur in an amount of less than 1 ppm by weight wherein the Fischer Tropsch diesel blend component has a peroxide number of less than 5 ppm after storage at 60° C. for four weeks.

* * * * *